US005809954A

United States Patent [19]

Devine et al.

[11] Patent Number: 5,809,954

[45] Date of Patent: Sep. 22, 1998

[54] FUEL INJECTION TIMING SYSTEM FOR UNIT INJECTORS

[75] Inventors: Michael J. Devine, Kent; Robert L. Kiliz, Sumner, both of Wash.

[73] Assignee: Timing Systems, Inc., Kent, Wash.

[21] Appl. No.: 772,814

[22] Filed: Dec. 24, 1996

[51] Int. Cl.[6] ..... F01L 1/34; F02M 37/04

[52] U.S. Cl. ..... 123/90.17; 123/500

[58] Field of Search ..... 123/496, 90.15, 123/90.16, 90.17, 90.6, 90.18, 500–502; 74/567, 568 R

[56] References Cited

U.S. PATENT DOCUMENTS

| | | | |
|---|---|---|---|
| 1,757,046 | 5/1930 | Horine | 123/90.17 |
| 2,059,804 | 11/1936 | Obryan | 123/500 |
| 3,913,548 | 10/1975 | Wilson | 123/496 |
| 4,335,686 | 6/1982 | Herdin et al. | 123/90.6 |
| 4,771,742 | 9/1988 | Nelson et al. | 123/90.17 |
| 5,085,099 | 2/1992 | Hughes | 123/90.6 |
| 5,165,303 | 11/1992 | Riemscheid et al. | 123/90.6 |
| 5,201,247 | 4/1993 | Maus et al. | 123/90.6 |
| 5,253,546 | 10/1993 | Elrod et al. | 123/90.6 |
| 5,253,622 | 10/1993 | Bornstein et al. | 123/90.17 |
| 5,305,718 | 4/1994 | Muller | 123/90.17 |
| 5,307,768 | 5/1994 | Beier et al. | 123/90.17 |
| 5,326,321 | 7/1994 | Chang | 123/90.17 |
| 5,329,895 | 7/1994 | Nishida et al. | 123/90.17 |
| 5,505,168 | 4/1996 | Nagai et al. | 123/90.6 |
| 5,577,420 | 11/1996 | Riemscheid et al. | 123/90.6 |
| 5,664,463 | 9/1997 | Amborn et al. | 123/90.6 |

*Primary Examiner*—Thomas N. Moulis

*Attorney, Agent, or Firm*—Delbert J. Barnard; Glenn D. Bellamy

[57] ABSTRACT

Start of fuel delivery for a fuel-injected engine having separate unit injectors is adjusted by effecting a positional adjustment of camshaft lobes on a camshaft. The camshaft is used to operate the unit injectors, as well as control exhaust valve operations. By separately controlling the position of the cam lobes which operate the unit fuel injectors, a change it start of fuel delivery is effected. A change in relative position of the cam lobes is accomplished by shifting a guide rod within a hollow body of the camshaft. The change in position of the guide rod, in turn, effects a change in position of the cam lobes which are connected to the guide rod.

15 Claims, 3 Drawing Sheets

FIG. 3
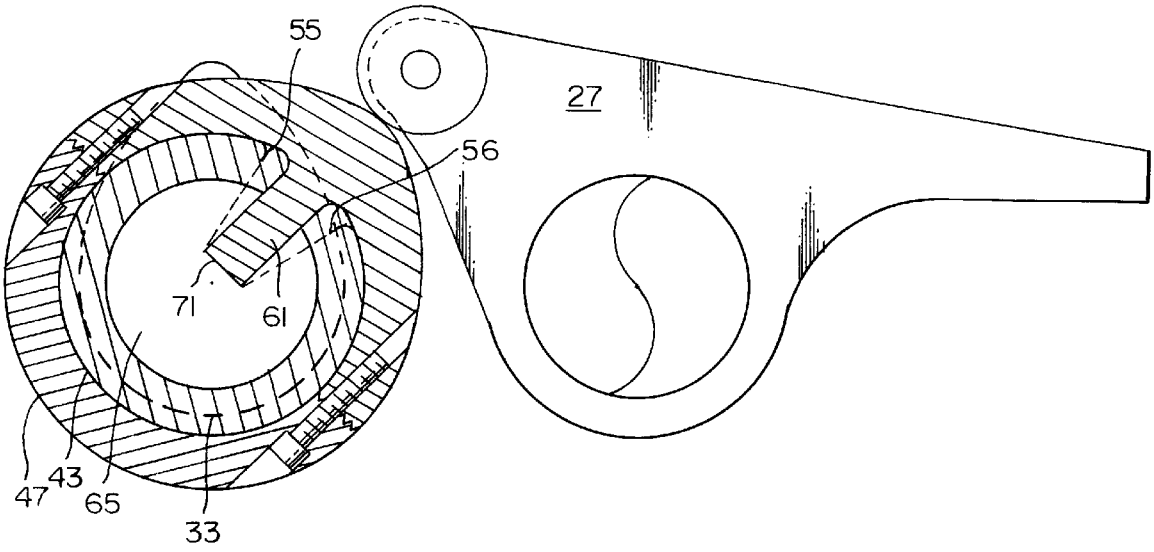
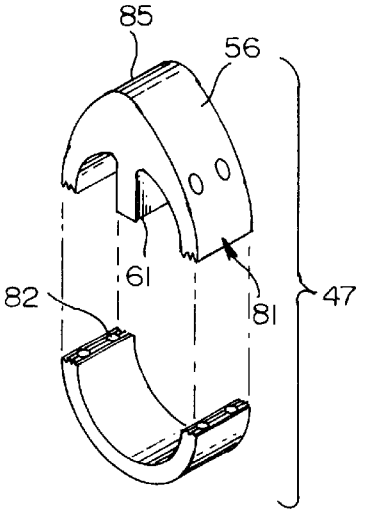
FIG. 4
FIG. 5
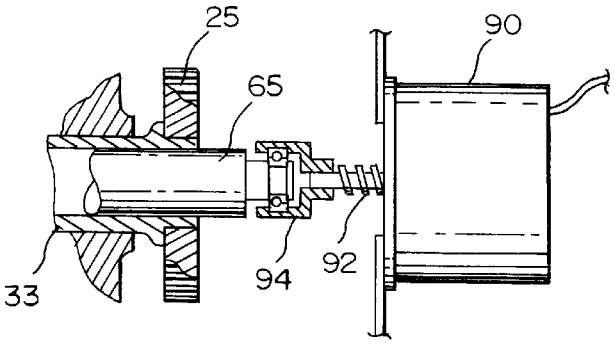

FUEL INJECTION TIMING SYSTEM FOR UNIT INJECTORS

TECHNICAL FIELD

The present invention pertains to fuel injection systems, and more particularly, to an apparatus for controlling the timing of unit fuel injectors in internal combustion engines.

BACKGROUND OF THE INVENTION

Timing of diesel fuel injection is typically accomplished by controlling "start of fuel delivery," by which a charge of fuel is delivered to a cylinder. Since diesels are compression ignition engines, the fuel normally begins combustion upon delivery of fuel into the combustion chamber. The combustion patterns therefore depends upon the start of delivery of fuel into the combustion chamber, as well as other factors relating to the ability of the pump to deliver the full charge to the cylinder. The timing is generally adjusted by changing the start of fuel delivery.

Large diesel engines for railroad locomotives use "unit injectors." By way of example, EMD engines manufactured by Electromotive Division of General Motors for railroad locomotives and other applications, use "unit injectors." Unit injectors are individual fuel injection cylinders which respond to cam lobes on an engine-driven camshaft. While the function is the same as that found on mechanical fuel injection pumps, unit injectors have the characteristic of using separate units for each cylinder of the engine. Furthermore, the unit injectors receive their timing directly from a camshaft on the engine, so that there is limited ability to change this without changing positions of components in the camshaft drive train. Therefore, the timing of a series of unit injector units is controlled by drive train timing, as transferred to a camshaft and is transferred to the unit injectors by camshaft action against the unit injectors.

In a typical system, the unit injectors are driven by a rocker arm, which, in turn, is driven by an injection timing camshaft. There is generally no timing control or deliberate change of timing during the operation of the engine. Since the engines are optimized for a predetermined engine speed, start of fuel delivery timing was believed not to be especially critical. On the other hand, this is not always the case and such engines are often operated at less than full power and full engine speed for extended periods of time. For this reason, it is desired to be able to adjust start of fuel delivery during the operation of the engine.

U.S. Pat. Nos. 3,934,430 to Fuso; 4,566,421 to Bauer et al.; 3,603,112 to Sola; 5,417,187 to Meyer et al.; and 5,447,126 to Kondoh et al. disclose various fuel injection pump timing systems that include intermediate couplings between a camshaft and a drive shaft. These intermediate couplings are axially adjustable by means of a drive source taken off of the engine. For example, Fuso discloses a hydraulic fluid pressure source (16), powered by the engine oil pump, that applies metered pressure to an inlet (22) of an hydraulic actuator of a injection timing control device (10).

U.S. patent application Ser. No. 08/666,081, filed on Jun. 19, 1996, to Devine and Kiliz and commonly assigned, discloses a timing system which comprises an output drive member which is rotationally coupled to a pump shaft of the injection pump. The output drive member rotates the injection pump shaft about its axis. An intermediate drive sleeve is provided and an actuator moves the intermediate sleeve along the pump shaft axis. The output drive member can be coupled to pump shafts of varying diameters, which allows the timing system to be retrofitted to existing diesel engines.

Such a system is ideally suited for use with an injection pump timed injection system, such as found on automobiles and trucks. In such arrangements, the injection pump is configured as an external gear-driven accessory or the equivalent, so that the use of an intermediate drive sleeve between the drive coupling and the pump does not interfere with the basic operation of the fuel injection drive system.

In certain unit injection engines, such as the EMD engines, the cam drive for the injection box is also the cam drive for the exhaust valves. Since the exhaust valves are timed as desired, any change in cam timing to change the injection timing would normally also change the exhaust valve timing, thereby decreasing performance.

SUMMARY OF THE INVENTION

In accordance with the present invention, an engine with a cam-driven device, such as a unit injector system, is provided with an adjustment in cam lobe position with respect a camshaft. This, in turn, effects a change in cam-induced timing of the cam-operated device. In the case of cam-operated unit fuel injectors, the cam lobes which are associated with the unit injectors are rotated about a rotational axis of the camshaft by providing a guide rod which is concentric with the camshaft and rotates with the camshaft.

The cam lobe guide rod fits within a hollow camshaft as an inside member. The guide rod is rotationally fixed with respect to the camshaft with an anti-rotation pin. An axial driver motor moves the cam lobe drive block axially in accordance with a corresponding timing position for the cam lobes.

The guide rod includes a lobe driver slot for each camshaft lobe to be affected. A lobe driver slot is engaged by a drive lug extending inwardly from the affected cam lobe, so that the position of the drive lug in the lobe driver slot rotationally fixes the cam lobe to a position on the camshaft. The drive lobe slot is aligned at an angle to the longitudinal direction of the camshaft lobe guide rod, so that axial movement of the guide rod causes a shift in the position of the lobe driver slot at a given location along the length of the camshaft. This, in turn, causes the rotational alignment of the lug on the cam lobe to shift. Thus, the cam lobe will be rotated relative to the camshaft according to the axial position of the guide rod.

When used with unit fuel injectors, the guide rod is used to adjust the timing of cam lobes which control the unit injectors. In the preferred embodiment, an axial drive motor is controlled electrically in accordance with a desired timing of the start of fuel delivery. The axial drive motor moves the lobe driver and cam lobes are shifted in accordance with the axial position of the lobe driver. Since the timing change is effected by moving those cam lobes which are driven by the lobe driver and not by changing the timing of the rest of the camshaft, other lobes in the camshaft remain unaffected by start of fuel delivery timing changes. In the case of engines which use the same camshaft for exhaust valve timing, the change in injector timing does not affect exhaust valve timing.

These and other features, objects, and advantages will become apparent from the following detailed description of the best mode, when read in conjunction with the enclosed drawings, and the claims, which are all incorporated herein as part of the disclosure of the invention.

BRIEF DESCRIPTION OF THE DRAWINGS

In the drawings, like reference numerals refer to like parts throughout the several views, wherein

FIG. 3 shows the camshaft and guide rod in cross-section;

FIG. 4 shows a configuration for a cam lobe used with the invention;

FIG. 5 shows a driving mechanism for axially positioning the lobe driver of FIGS. 2 and 3.

DETAILED DESCRIPTION OF THE PREFERRED EMBODIMENTS

Figure 1:
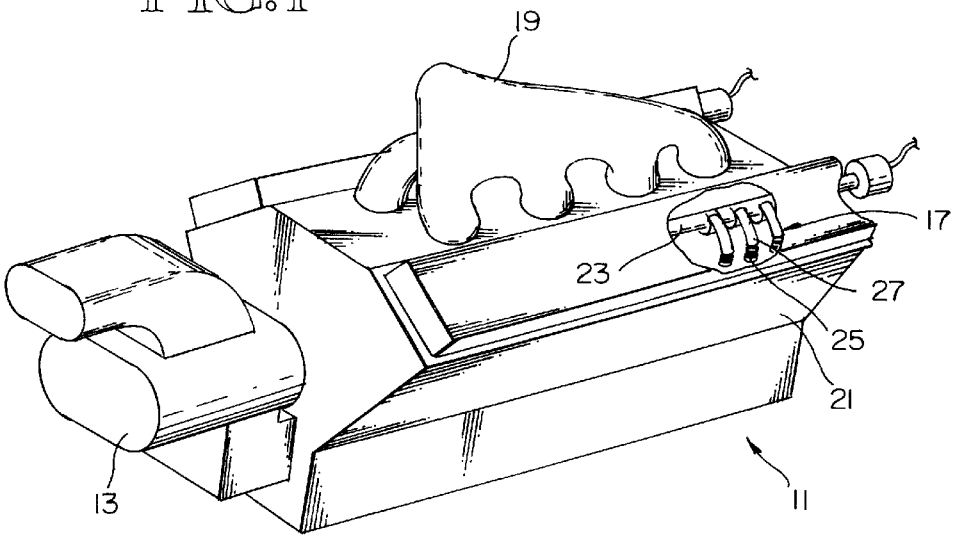
FIG. 1 shows a general configuration of a large diesel engine, showing an arrangement for unit injectors.

Referring to FIG. 1, a large diesel engine 11 may be any of a variety of designs, including two-stroke and four-stroke diesels. In the case of a two-stroke diesel, an intake, represented by supercharger 13, directs air through intake ports (not shown). As with a four-stroke engine, exhaust is controlled by exhaust valves 17. For this reason, the intake (supercharger 13) is shown at a lower portion of the block 19 and the exhaust 21 is shown located at the appropriate location adjacent the engine's block 19 near the cylinder heads. The exhaust valves 17 are driven by a camshaft 23, which also drives a plurality of unit fuel injectors 25. The camshaft 23 is driven by a driving gear (not shown) which is driven by the engine's crank shaft.

The unit fuel injectors 25 are driven by rocker arms 27 and share the same camshaft 23 as the exhaust valves 17. In the prior art, the camshaft was forged so that the relative positions of the cams were such that a pre-selected timing of start of fuel delivery and exhaust valve timing were obtained, provided that the camshaft was in proper gear alignment with the engine's crank shaft.

Referring to FIG. 3, the camshaft 23 used with the present invention includes a camshaft body 33, which is driven by a camshaft drive gear (drive gear 25 shown in FIG. 5), which causes the camshaft 23 to rotate once per engine cycle, in the conventional manner. The camshaft body 33 includes bearings 39 and camshaft lobes 41 for actuating the engine's exhaust valves 17 (FIG. 1). Instead of fixed cam lobes for unit fuel injectors, the camshaft body 33 has cam seats 43 upon which separate fuel injection cams 47 rest, as shown in FIG. 3. Therefore, while the cam lobes 41 for the exhaust valves 17 are fixed portions of the camshaft body 33, the cams 47 for the unit injectors 25 are not attached to the cam body 33, but instead are free to rotate within a limited range on the cam seats 43. The axial movement of the unit injector cams 47 is restrained by flanges 51, 52.

Still referring to FIG. 3, the unit injector cams 47 rest against the cam seats 43. A slot defined by end walls 55, 56 provide a gap for a drive lug 61 to extend through the camshaft body 33. The gap formed by the end walls 55, 56 is large enough to permit the cam 47 to freely rotate within a limited range about the camshaft body 33. Under normal circumstances, the end walls 55, 56 do not provide stops for the unit injector cams 47, although, in the event of failure of a drive mechanism for the lug 61, the end wall 55 or 56 which is at a retard position would, in fact, prevent further movement of the cam 47.

In normal operation, movement of the cam 47 is controlled by a guide rod 65, which is inside the cam body 33. The guide rod 65 is maintained in rotational synchronism with the cam body 33 by an anti-rotation pin 67, which fits through cooperating bores 68 in the cam body 33 and a longitudinal slot 69 in the guide rod 65. This causes the guide rod 65 to be rotationally fixed to the cam body 33 and therefore rotate with the cam body 33. The precise manner of fixing the guide rod 65 with the cam body 33 can vary, including the use of tabs and keyway grooves or any other convenient method. In the preferred embodiment, the guide rod 65 is able to be moved longitudinally within the cam body 33.

A helical slot 71 is formed in the guide rod 65 and accepts the drive lug 61. By the cam rod 65 shifting in a longitudinal direction with respect to the cam body 33, the drive lug 61 becomes positioned at different portions of the helical slot 71. The drive lug 61 remains longitudinally fixed to the cam body 33 due to the fact that the cams 47 are restrained in their longitudinal movement by the flanges 51, 52. Consequently, the cams 47 are unable to shift longitudinally with the guide rod 65. Since the drive lug 61 on each of the unit injector cams 47 fit within the slots 71, longitudinal movement of the drive rod 65 causes the cams 47 to change their angular positions with respect to the cam body 33. Thus, movement of the guide rod 65 in one direction causes the relative location of the slot 71 as it appears at the opening between the end walls 55, 56 to shift. The drive lug 61 rests in the slot 71, so that a shift in this relative position, caused by a longitudinal shift in the position of the guide rod 65 within the cam body 33 causes the cam 47 to shift. The drive lug 65 is set at an angle to the longitudinal direction of the camshaft body 33 so that the drive lug 61 conforms with the corresponding angle formed by the helical slot 71.

Referring to FIG. 4, in order for cam 47 to fit into its position over the cam seat 43, the cam 47 is assembled from two halves 81, 82. The halves 81, 82 preferably meet at a location on the cam which is other than on thrust face 85 of the cam 47, so that the rocker arm 27 is able to properly glide across the cam 47.

An electric motor 90 is used to control movement of the guide rod 65, as shown in FIG. 5. Motor 90 is attached to a threaded gear linear actuator 92 that is adapted to threadably mate with a coupling 94. Motor 90 is preferably an electronically-driven stepper motor, controlled by a microprocessor controller, discussed later. Rotation of gear actuator 92 causes the coupling 94 to move linearly, which, in turn, causes the guide rod 65 to follow.

It is possible to move the guide rod 65 differently in order to achieve relative movement of the cams 47. For example, the guide rod 65 would be caused to rotate within the cam body 33. If that is accomplished, then it would not be necessary to provide the slot 71 at an angle. It is only necessary that the cams 47 be shifted in their angular relationship to the cam body 33.

Figure 2:
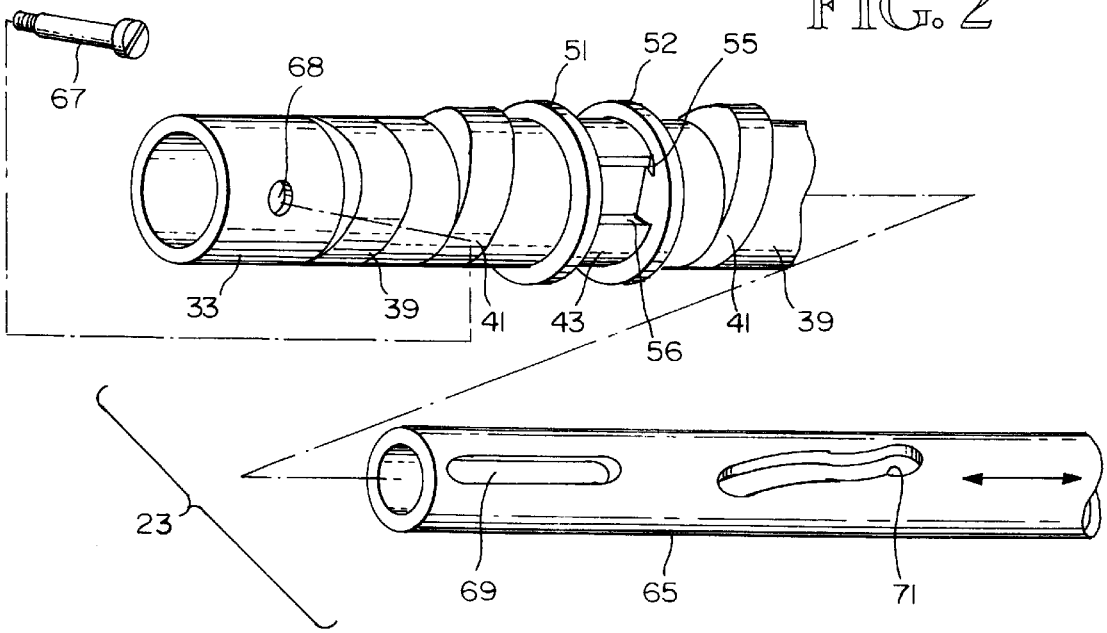
FIG. 2 shows a camshaft in an exploded view in which an axially-displacement guide rod lobe driver is provided.

In a second embodiment, a hollow camshaft body is provided with a guide rod which shifts in its angular position with respect to the camshaft body. The camshaft body is constructed in the same manner as camshaft body shown in FIG. 2. Instead of using a straight slot, such as slot shown in FIG. 2, camshaft rod has a slot which exhibits a helical twist. As the guide rod is longitudinally shifted with respect to the camshaft body, the guide rod shifts in its rotational position with respect to the camshaft body. A plurality of longitudinal slots are formed in the guide rod and accept corresponding lugs on cam lobes. The cam lobes correspond to those shown in FIG. 4, with the exception that the drive lug 61 need not be cut at an angle to the longitudinal. Since the guide rod rotates with respect to the cam body, the relative position of the slots shifts, thereby causing the relative positions of the cam lobes to shift. The cam lobes rest on cam seats which have the configuration of cam seats and flanges shown in FIG. 3.

Figure 6:
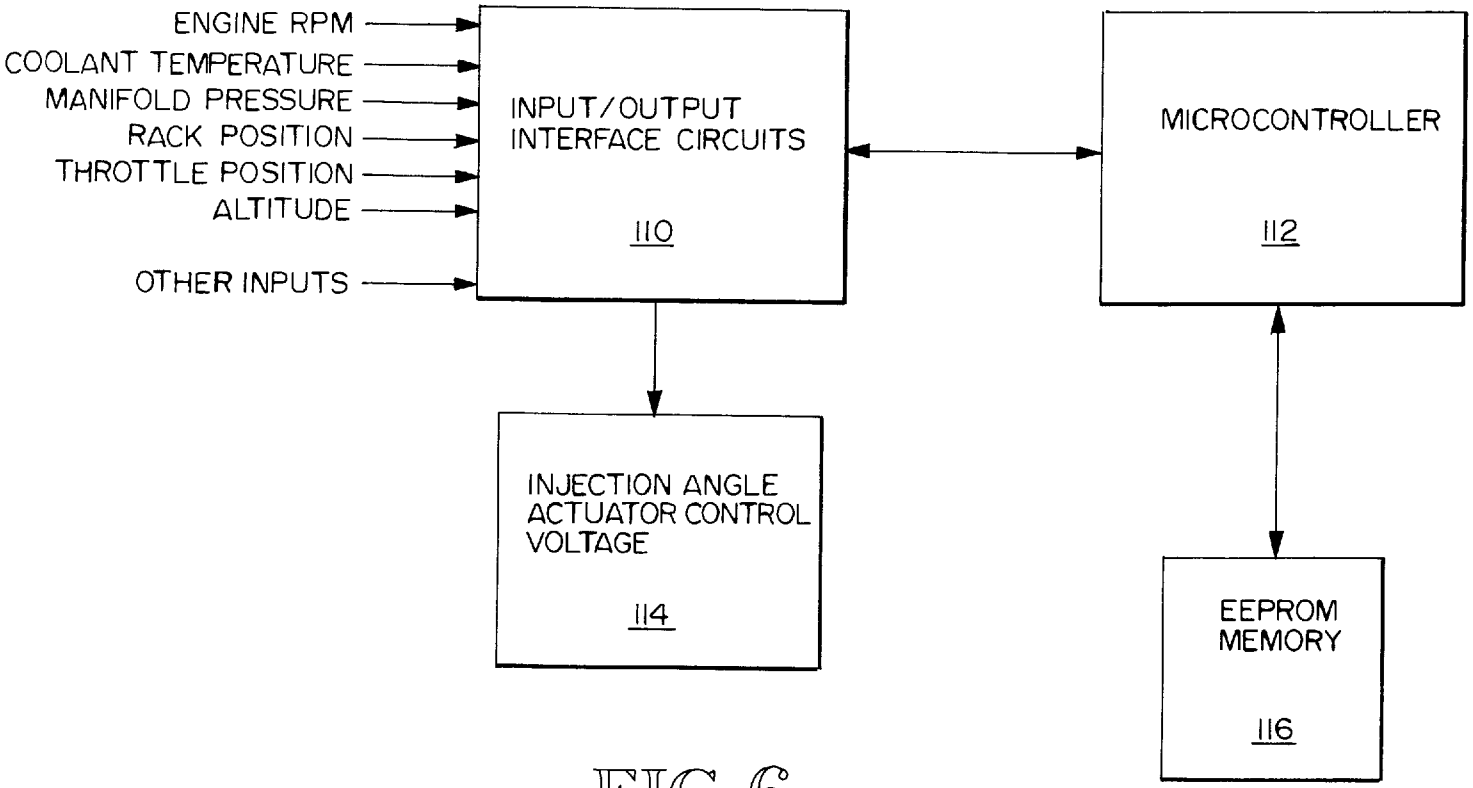
FIG. 6 is a diagram of an electronic Control System.

The timing system of the present invention includes an electronic control system, depicted schematically in FIG. 6. A position sensor is mechanically coupled to the gear actuator of the stepper motor. The position sensor creates a voltage that represents the current position of the stepper motor, which corresponds to the start of fuel delivery.

An input/output interface circuit 110 receives input signals from various engine inputs, as listed in FIG. 6, and conditions these signals for a microprocessor controller 112. Input/output interface circuit 110 also receives a voltage signal from the stepper motor position sensor. Circuitry 110 also conditions and sends an actuator control signal 114 to the stepper motor 90.

Some of the various inputs may be eliminated. For example, as mentioned before, it is possible to assume altitude at approximately standard sea level altitude for some applications.

Microprocessor controller 112 calculates the proper injection angle using the monitored parameters previously discussed and a look-up table. The look-up table is stored in an EEPROM 116. EEPROM 116 is pre-programmed with the necessary injection angle control information for the particular type of engine being controlled. The look-up table for a particular engine is a multidimensional map of the ideal injection angle versus operating conditions. Microprocessor controller 112 sends a signal, via input/output interface 110, to the motor 90 to move the guide rod 105 to its proper position.

In the preferred embodiment, the movement of the guide rod 65 is sufficient to effect a shift of 10° in the start of fuel delivery. This permits the start of fuel delivery to be optimized for full power, idle, and other operating conditions. Therefore, the cam lobes 41 are preferrably shifted by 10°. In order to provide a range of adjustment, the cam lobes 41 may be shifted by as much as 12°, 15°, 20° or 25°. The limitation on amount of available shift in cam adjustment are convenience of manufacture, a desire to limit maximum travel in the event of timing control failure and the fact that one would not consider timing start of fuel delivery beyond a limited range. As mentioned, the cam lobes 41 have a tendency of retarding their positions absent any constraining force exerted by the guide rod 65. Therefore, a minimum position of the cam lobes 41 would be at a start of fuel delivery which would be retarded for starting but would permit minimal operation of the engine 11.

It is recognized that some of the above factors may not be incorporated into the production embodiment. For example, one would not be particularly concerned with altitude when fitting the inventive timing mechanism to a marine engine. The different factors were originally developed for engines which are smaller than the EMD engine, and, therefore, used in different types of service.

At engine start up, the timing device of the present invention achieves significant advantages over prior systems. The inventive timing device can retard the timing of a diesel engine at start up, by removing the electrical power source required by motor 90. It is not necessary that the engine be running for my device to work, because movement of the guide rod 105 can be effected with the electric motor 90. Such engine timing control prior to start up can decrease cold start problems. With stricter engine start up emission requirements scheduled to be mandated in the future, the present invention provides a low cost, yet effective system for meeting these requirements.

Additionally, as engine rpm increases, the timing of the start of fuel delivery can be advanced or retarded as dictated by the engine rpm, exhaust temperature, manifold temperature, coolant temperature, engine load, crankshaft speed, throttle position, altitude, and other criteria, as is well understood by those skilled in the art. Diesel engines equipped with the present invention should also realize increased fuel efficiency and increased horsepower and meet emission requirement changes without the need for other more complicated and expensive control systems.

With this arrangement, the timing device can be retrofitted to a variety of camshaft drives and unit fuel injectors. The present invention will enable older diesel engines to meet engine emission requirements, especially as such emission requirements are made stricter in the future.

What is claimed is:

1. A fuel injection timing system for controlling fuel delivery by cam-operated unit injectors, comprising:

an elongated, tubular camshaft body that in use rotates about a longitudinal axis;

at least one cam having a cam body supported on and encircling the camshaft body and a lobe on the cam body, said cam body being rotatable in position on the camshaft body, for moving the lobe in position about the longitudinal axis; and a longitudinally movable position control rod within said camshaft body which engages the cam body and causes the cam body to rotate in position on the camshaft body, about the longitudinal axis, in response to longitudinal movement of the position control rod relative to the camshaft body, for effecting a relative timing change between the cam lobe and the camshaft body.

2. The fuel injection timing system of claim 1, further comprising at least one fixed cam on the camshaft body, said fixed cam including a cam lobe, whereby a relative change in position of the cam that is rotatable in position on the camshaft body will change the position of the lobe of such cam relative to the lobe of the fixed cam, to effect a change in timing between the lobe on the fixed cam and the lobe on the cam that is rotatable in position on the camshaft body.

3. The fuel injection timing system of claim 1, comprising connection means between the position control rod and the cam that is rotatable in position on the camshaft body, and means for moving the position control rod longitudinally, wherein in response to longitudinal movement of the position control rod relative to the camshaft body, the cam will rotate in position on the camshaft body to effect said relative timing change between the lobe of said cam and the camshaft body.

4. The fuel injection timing system of claim 2, comprising connection means between the position control rod and the cam that is rotatable in position on the camshaft body, and means for moving the position control rod longitudinally, wherein in response to longitudinal movement of the position control rod relative to the camshaft body, the cam will rotate in position on the camshaft body to effect said relative timing change between the lobe of said cam and the camshaft body.

5. The fuel injection timing system of claim 3, wherein the elongated position control rod is connected to the camshaft body by a slot and pin connection, said slot extending longitudinally of the camshaft body and the control rod, said pin being positioned within said slot, and said pin and slot locking the camshaft body and the control rod together, so that they rotate together, but permitting longitudinal movement of the control rod relative to the camshaft body.

6. The fuel injection system of claim 5, further comprising at least one fixed cam on the camshaft body, said fixed cam including a cam lobe, whereby a relative change in position of the cam that is rotatable in position on the camshaft body will change the position of the lobe on such cam relative to the lobe on the fixed cam, to effect a change in timing between the lobe on the fixed cam and the lobe on the cam that is rotatable in position on the camshaft body.

7. The fuel injection timing system of claim 3, wherein the position control rod includes an elongated, radially outwardly opening control slot, wherein the cam that is rotatable in position on the camshaft body includes a control pin that projects radially inwardly into the slot, and wherein said control slot is configured to move the pin on the cam for causing movement of the cam and its cam lobe relative to the camshaft body in response to a longitudinal movement of the control rod.

8. The fuel injection timing system of claim 7, further comprising at least one fixed cam on the camshaft body, said fixed cam including a cam lobe, whereby relative change in position of the cam that is rotatable in position on the camshaft body will change the position of the lobe on such cam relative to the lobe on the fixed cam, to effect a change in timing between the lobe on the fixed cam and the lobe on the cam that is rotatable in position on the camshaft body.

9. The fuel injection timing system of claim 3, comprising a control rod positioning motor having an output connected to the control rod and operable for moving the control rod longitudinally relative to the camshaft body.

10. The fuel injection timing system of claim 9, wherein the motor is a stepper motor.

11. The fuel injection timing system of claim 1, wherein the crank shaft body includes a circular, reduced diameter cam mounting portion flanked on each side by axial movement restraining portions, and said cam body encircles said reduced diameter cam mounting portion.

12. The fuel injection timing system of claim 11, wherein the cam body is of a two-part construction, and the two parts come together about the reduced diameter cam mounting portion of the camshaft body and are connected together.

13. The fuel injection timing system of claim 5, wherein the position control rod includes an elongated, radially outwardly opening control slot, wherein the cam that is rotatable in position on the camshaft body includes a control pin that projects radially inwardly into the slot, and wherein said control slot is configured to move the pin on the cam for causing movement of the cam and its cam lobe relative to the camshaft body in response to a longitudinal movement of the control rod.

14. The fuel injection timing system of claim 11, wherein the elongated position control rod is connected to the camshaft body by a slot and pin connection, said slot extending longitudinally of the camshaft body and the control rod, said pin being positioned within said slot, and said pin and slot locking the camshaft body and the control rod together, so that they will rotate together, but permitting longitudinal movement of the control rod relative to the camshaft body.

15. The fuel injection timing system of claim 14, wherein the position control rod includes an elongated, radially outwardly opening control slot, wherein the cam that is rotatable in position on the camshaft body includes a control pin that projects radially inwardly into the slot, and wherein said control slot is configured to move the pin on the cam for causing movement of the cam and its cam lobe relative to the camshaft body in response to a longitudinal movement of the control rod.

* * * * *

UNITED STATES PATENT AND TRADEMARK OFFICE

CERTIFICATE OF CORRECTION

PATENT NO: 5,809,954

DATED: September 22, 1998

INVENTOR(S): Michael J. Devine and Robert L. Kiliz

It is certified that error appears in the above-identified patent and that said Letters Patent is hereby corrected as shown below:

In the Abstract, [57], line 7, "it" should be -- in --.

In column 3, line 11, "Control System" should be -- control system --.

In claim 5, column 6, line 63, after "they", insert -- will --.

Signed and Sealed this

Twenty-second Day of June, 1999

*Attest:*

Q. TODD DICKINSON

*Attesting Officer*

*Acting Commissioner of Patents and Trademarks*